United States Patent [19]

Fast

[11] Patent Number: 4,995,182

[45] Date of Patent: Feb. 26, 1991

[54] SIGN HOLDER WITH SHELF ATTACHMENT

[76] Inventor: Jacob Fast, 7561 NW. 9th Street, Plantation, Fla. 33317

[21] Appl. No.: 224,822

[22] Filed: Jul. 27, 1988

[51] Int. Cl.[5] ..... G09F 3/20

[52] U.S. Cl. ..... 40/649; 40/124.4; 40/539

[58] Field of Search ..... 40/642, 663, 649, 124.1, 40/124.4, 539, 657; 248/220.2, 220.4

[56] References Cited

U.S. PATENT DOCUMENTS

| | | | |
|---|---|---|---|
| 4,222,187 | 9/1980 | Huck | 40/124.4 |
| 4,485,575 | 12/1984 | Fast | 40/649 |
| 4,718,627 | 1/1988 | Fast et al. | 248/225.1 |
| 4,798,014 | 1/1989 | Stoerzinger et al. | 40/124.1 |

*Primary Examiner*—Gene Mancene
*Assistant Examiner*—Michael Lynch
*Attorney, Agent, or Firm*—Fleit, Jacobson, Cohn, Price, Holman & Stern

[57] ABSTRACT

A sign holder is disclosed for use in attaching label cards or other signs in prominent positions projecting from a front edge of supermarket and like product display shelves. The sign holder has a box-shaped body portion made of a plastic sheet with a slit therein for receiving a label or other card. A mounting panel extends from the box-shaped body portion for attachment to an upper surface of a shelf with the body portion projecting from the front of the shelf. The mounting panel may have a depressable head formation for insertion in a perforation of a perforated shelf.

7 Claims, 1 Drawing Sheet

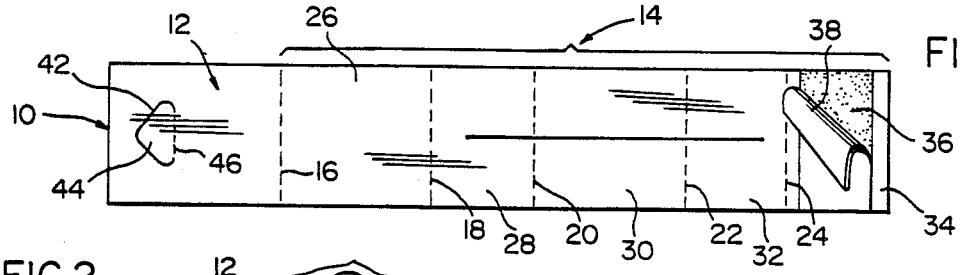
FIG. 1
FIG. 2
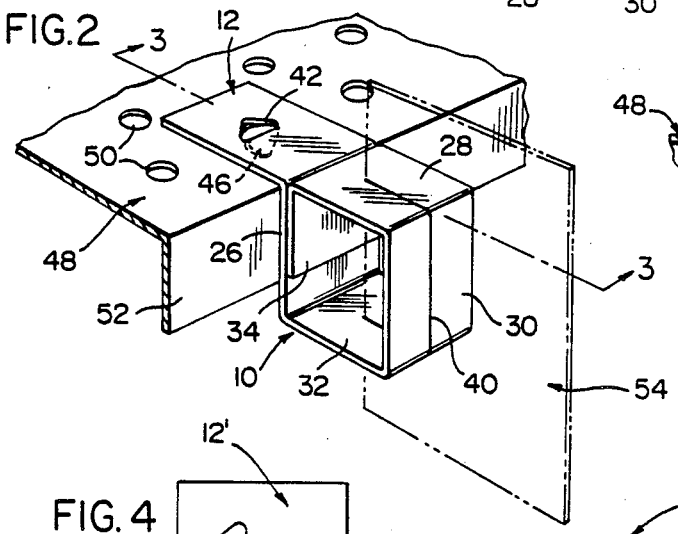
FIG. 3
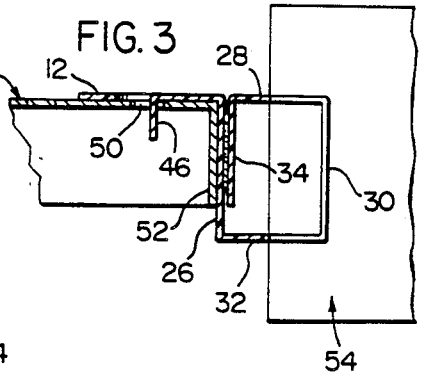
FIG. 4
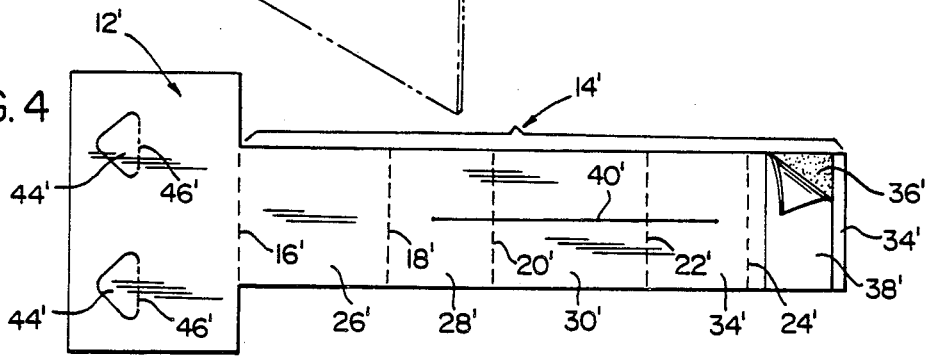
FIG. 5
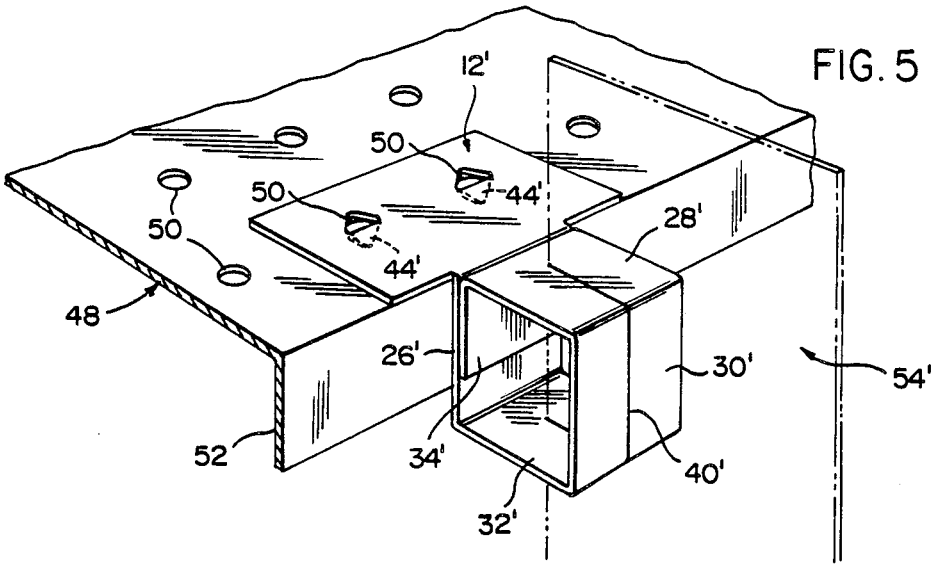

SIGN HOLDER WITH SHELF ATTACHMENT

BACKGROUND OF THE INVENTION

This invention relates to a sign holder, more particularly for use in supermarkets and other stores for attaching signs, labels, and the like to product display shelves, more particularly perforated type shelves.

In supermarkets and the like, it is frequently desirable to position short-term signs, for example, signs which advertise special offers, sale prices and the like on product display shelves in positions where they will readily catch a consumer's eye, and in a manner whereby the signs may be readily attached and detached. The present invention provides a sign holder particularly suited for this purpose, for positioning a sign in a prominent location at the forward edge of a product display shelf projecting into the aisle perpendicular to the plane of the shelf.

There are molded pieces which fit into a price channel to do this and can be relocated. However, they cannot be used on shelves without price channel. This holder can be used for shelves without price channel or with price channel as long as the shelves are perforated.

SUMMARY OF THE INVENTION

It is an object of the invention to provide a sign holder as aforesaid which is extremely simple and economical to manufacture, which is compact in storage and transport and which can be readily attached to and detached from a product display shelf while providing secure attachment for a sign or label at the forward edge of the shelf which projects into the aisle perpendicular to the plane of the shelf.

In accordance with the invention, a sign holder therefore is formed from a sheet of flexible plastic material which has a mounting panel and an elongate body portion extending from the mounting panel. The body portion may itself be divided into a series of panels by transverse fold lines or the like and an endmost panel of the body portion remote from the mounting panel may be provided with adhesive on one surface. This structure allows the body portion to be folded about the transverse lines into a box-shape configuration and the endmost panel with the adhesive may then be adhesively secured to the panel adjacent the mounting portion. Further, the intermediate panels of the body portion may include a lengthwise slit for receiving a sign or label card when the body portion is formed into its box-like shape. The mounting panel is provided with attachment means for securing same flat against the top surface of a shelf at its forward edge with the folded box-like body portion projecting forwardly and downwardly from the shelf at its forward edge. When the sign or label card is located and firmly retained in the slit by friction, it projects in a prominent position from the forward edge of the shelf. The attachment means on the mounting panel may, for example, comprise at least one depressable arrowhead formation for insertion into a perforation of a perforated shelf. Other forms of attachment means, such as adhesive, may also be used, for example, for non-perforated shelves.

Additional objects and advantages of the invention will become apparent from the ensuing description and claims read in conjunction with the attached drawings.

BRIEF DESCRIPTION OF THE DRAWINGS

FIG. 1 is a plan view of a blank for making a first embodiment sign holder in accordance with the invention.

FIG. 2 is a perspective view of the blank folded into a sign holder, attached to a product display shelf, and having a display sign mounted therein.

FIG. 3 is a sectional view on line 3—3 of FIG. 2.

FIG. 4 is a view similar to FIG. 1 of a second embodiment blank.

FIG. 5 is a view similar to FIG. 2 showing the second embodiment blank folded into a sign holder, attached to a shelf, and receiving a display sign.

DESCRIPTION OF PREFERRED EMBODIMENT

Referring initially to FIG. 1, there is shown a blank 10 for folding into a first embodiment sign holder, the blank, for example, being die-cut in sheet plastic material of a type well known for such purposes. The blank has a mounting panel 12 and an elongate body portion 14 separated from the mounting panel 12 by a first transverse score or fold line 16. The body portion is itself divided by further transverse score or fold lines 18 through 24 into five adjacent panels 26 through 34. The outermost panel 34 on one surface is provided with a strip of pressure sensitive adhesive 36 normally covered by a layer of release paper 38. An elongate slit 40 is provided along the entire length of panel 30 and extends part way into the adjacent panels 28 and 32. The mounting panel 12 is itself provided with a slit 42 defining a generally arrow shaped depressable head 44 which can be depressed about its base 46.

To form the blank 10 into a sign holder, release paper 38 is removed and the respective panels 26 through 34 which define the body portion 14 are folded about their respective fold lines 18 through 24 so as to form a box shape configuration as illustrated in FIG. 2. The pressure sensitive adhesive 36 is used to adhere panel 34 to the inside of panel 26 as shown in FIG. 2. The depressable head 44 is suitable for securing the holder 10 to a front edge of a perforated shelf 48 by depressing the head, flexing it laterally and inserting into one of the perforations 50 of the shelf adjacent the shelf forward edge 52. Clearly, the dimensions of the head 44 are such as to allow for this insertion of the head into perforation 50 and the length of panel 12 is preferably such that the box shaped body portion of the holder will sit in the manner shown adjacent the front edge 52 of the shelf. It is evident that in the position of the holder shown, slit 40 in the holder is presented forwardly of the shelf for insertion therein of a sign or label card 54. When the card 54 is made of thin paper, it may be inserted by pressing one side of the holder adjacent the slit 40 flat, holding the paper at the slit position and bringing the flat side of the holder back into its original position. It is evident that the holder thereby provides a secure frictional retention of card 54 in a prominent position adjacent the front of the shelf.

FIGS. 4 and 5 show a second embodiment blank and holder in accordance with the invention which is very similar to the first embodiment holder and accordingly, like reference numerals, with primes, are used to denote the like parts. The difference of the second embodiment is that the mounting panel 12' is wider than the body portion 14' and is provided with a pair of the previously described depressable heads 44' instead of a single head as in the first embodiment. This arrangement enables the holder to be attached to two adjacent perforations 50 of the perforated shelf and provides a somewhat more stabilized and secure mounting for the holder where, for example, heavier label cards 54' are to be used.

While only a preferred embodiment of the invention has been described herein in detail, the invention is not limited thereby and modifications can be made within the scope of the attached claims.

What is claimed is:

1. A sign holder for attachment to supermarket and like product-display shelving for mounting a label or like card in a prominent position projecting from a front edge of a shelf, the holder comprising an elongate member in the form of a strip of flexible sheet material having a mounting panel, an elongate body portion extending from the mounting panel, securing means for securing a distal part of the body portion remote from the mounting panel to a proximal part of the body portion adjacent the mounting panel in a manner forming the body portion into a closed-loop formation, an elongate slit in the body portion between said parts for receiving the label or like card, and attachment means on the mounting panel for attaching the same to a shelf with the closed-loop formation projecting adjacent a front edge of the shelf.

2. A sign holder as defined in claim 1 wherein the body portion is divided by transverse fold lines into first, second, third, fourth and fifth body panels, whereby the body portion may be folded into a rectangular box-shaped closed loop formation, the first of said panels constituting the proximal part of the body portion and the fifth of said panels constituting the distal part of the body portion.

3. A sign holder as defined in claim 2 wherein the slit extends along the entire length of the third body panel and part way into the second and fourth body panels.

4. A sign holder as defined in claim 2 wherein the securing means is contact adhesive on a surface of one of the first and fifth body panels.

5. A sign holder as defined in claim 1 wherein the attachment means comprises at least one depressable head formation in the mounting panel.

6. A sign holder for attachment to supermarket and like product-display shelving for mounting a label or like card in a prominent position from a front edge of a shelf, the sign holder comprising an elongate member formed into a closed-loop shaped body portion of flexible sheet-like material, and a mounting panel extending from the body portion for attaching the holder to a shelf with the body portion projecting from a front edge of the shelf, an elongate slit in the body portion for receiving a label or like card, and attachment means on the mounting panel for securing same on the shelf, said body portion being of a rectangular box-shaped form having an upper panel extending from the mounting panel, a front panel depending from the upper panel, a rear panel depending from the upper panel, and a lower panel connecting the front and rear panels, and wherein the slit extends long the entire height of the front panel and part way into the upper and lower panels.

7. A sign holder according to claim 6 wherein the attachment means comprises at least one depressable head formation in the mounting panel for insertion in a shelf aperture.

* * * * *